US005355875A

United States Patent [19]

Siegel

[11] Patent Number: 5,355,875

[45] Date of Patent: Oct. 18, 1994

[54] PROTECTIVE GARMENT USING ONE-WAY VALVES

[75] Inventor: John H. Siegel, Des Moines, Wash.

[73] Assignee: Vinatronics Division, Seattle, Wash.

[21] Appl. No.: 131,583

[22] Filed: Oct. 5, 1993

Related U.S. Application Data

[63] Continuation-in-part of Ser. No. 956,740, Oct. 6, 1992.

[51] Int. Cl.[5] ..... A62B 17/00

[52] U.S. Cl. ..... 128/201.29; 128/201.28; 128/205.24

[58] Field of Search ..... 128/201.23, 201.25, 128/201.28, 201.29, 205.24

[56] References Cited

U.S. PATENT DOCUMENTS

| | | | |
|---|---|---|---|
| 3,527,242 | 9/1970 | Ansite | 137/102 |
| 4,458,680 | 7/1984 | Childers et al. | 128/201.29 |
| 4,565,214 | 1/1986 | Parman | 137/512.15 |

FOREIGN PATENT DOCUMENTS 1600614 10/1981 United Kingdom .

*Primary Examiner*—Edgar S. Burr
*Assistant Examiner*—Aaron J. Lewis
*Attorney, Agent, or Firm*—Shlesinger Arkwright & Garvey

[57] ABSTRACT

An anti-contamination suit having one-way valves for use in expelling air from the suit of protective clothing so that a constant flow of air from an outside source can supply fresh, uncontaminated air to the suit of the wearer to facilitate respiration and provide cooling to the wearer.

5 Claims, 3 Drawing Sheets

PROTECTIVE GARMENT USING ONE-WAY VALVES

CROSS REFERENCE TO RELATED APPLICATIONS

This application is a continuation-in-part of Ser. No. 07,956,740, filed on Oct. 6, 1992 pending.

FIELD OF THE INVENTION

This invention relates to protective garments for working in hazardous areas and more particularly to valves used in combination with the protective garments permit a flow of cooling and respiratory air through the garment.

BACKGROUND OF THE INVENTION

This invention generally relates to valves and garments as described in co-pending U.S. application Ser. No. 07/956,740, filed Oct. 6, 1992, entitled "One-Way Valve" the disclosure of which is incorporated herein by reference.

Air-tight protective clothing has long been used for protecting workers in contaminated areas, an example of which being U.S. Pat. No. 4,458,680 of Childers et al. issued on Jul. 10, 1984. A major problem encountered with such suits is that disclosed by Childers is that the suit will generally operate satisfactorily when the wearer is standing with arms straight. However, many times the wearer is required by the specific job to bend over or crouch in position in which the air flow to portions of the suit is cut off which will restrict the out flow of air through some of the valves, thereby requiring all of the air entering the suit to be exhausted through only one or two valves. This occurrence can cause excessive ballooning or even rupture of the anti-contamination suit.

In view of the foregoing, it can be seen that there is a need for a new design for an anti-contamination suit which includes strategic locations of exhaust air valves combined with one-way exhaust valves of construction which can provide adequate exhausting capability and prevent bursting and excessive ballooning of the anti-contamination suit.

OBJECTS AND SUMMARY OF THE INVENTION

One object of the invention is to provide an anti-contamination suit having one-way valves which permit the exhaust of air from the suit while restricting ingress of contaminated air from outside the suit.

Another object of the invention is to provide one-way valves which have sufficient exhaust capacity to prevent undesirable ballooning and/or bursting of the anti-contamination suit even when some of the valves have been blocked off.

Still another object of the invention is to provide a valve structure having a flattened rear surface for preventing irritation to the wearer when the wearer is lying on or against the valve.

Still another object of the invention is to provide a webbed valve exhaust structure to facilitate high air flow exhaust through the valve.

In summary, therefore, the invention relates to an anti-contamination suit having one-way valves for use in expelling air from this suit of protective clothing so that a constant flow of air from an outside source can supply fresh, uncontaminated air to the suit of the wearer to facilitate respiration and provide cooling to the wearer.

The one-way valve is preferably formed of light-weight material such as plastic preferably one of the groups of: polyethylene, 5/B polyurethane, polyvinylchloride, and spunbound polyolefin and preferably includes a highly flexible rubber or plastic membrane which seals against a sealing edge to prevent backflow of air through the valve, but at the same time may be readily lifted off the edge by air flowing in the desired exhaust direction. An enlarged flange extends about the valve which may be sealed by suitable means such as adhesive or heat to the protective clothing in which the valve is intended to be installed. The anti-contamination suit is formed of air impermeable material, preferably one of the groups of: polyethylene, 5/B polyurethane, polyvinylchloride and spunbound polyolefin. An air supply is connected to the anti-contamination suit by suitable fitting.

Other features and advantages of the invention will be set forth in an apparent from the detailed description of the preferred embodiments of the invention which follows.

DETAILED DESCRIPTION OF THE DRAWINGS

Figure 1:
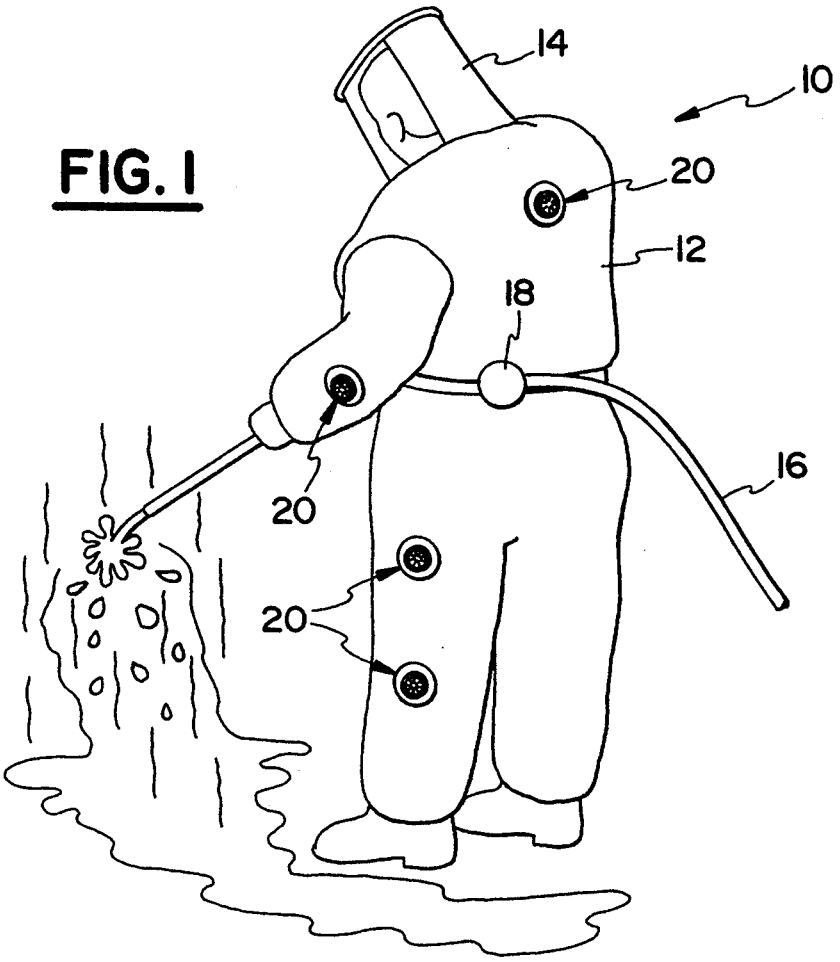
FIG. 1 generally shows a worker wearing an anti-contamination suit.

FIG. 1 generally shows a worker wearing anti-contamination suit 10 having a body garment 12 and a hood 14. An air hose 16 supplies air to the suit 10 and is connected to the body garment 12 at a suitable fitting 18. The anti-contamination suit 10 includes a plurality of exhaust valves 20 strategically located to exhaust air from the suit 10.

Figure 2:
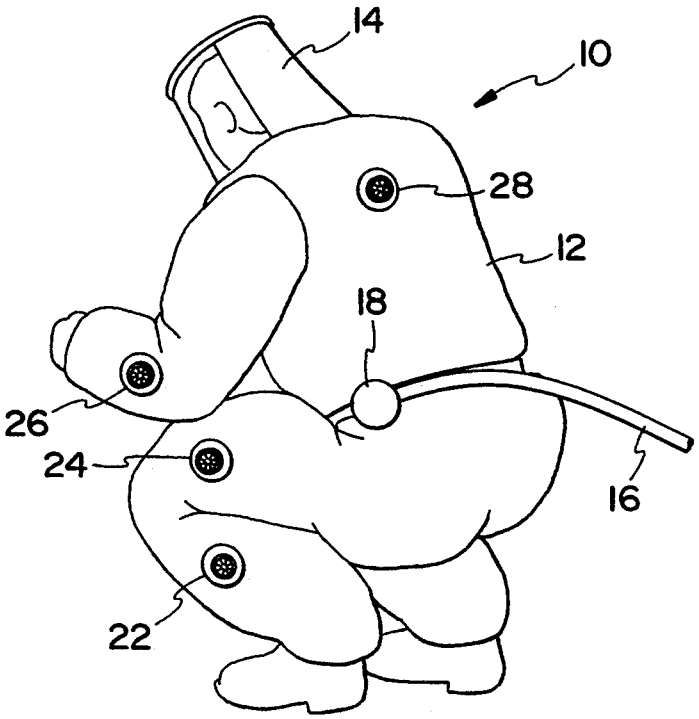
FIG. 2 shows a worker in a crouched position wearing the anti-contamination suit.

FIG. 2 shows the worker in a crouched position which can cause restricted air flow to certain portions of the suit due to constriction at the knees, hips and elbows. When air flow is thus restricted, no air will exhaust through the valves 22 and 24 and 26, but virtually all of the air entering the suit will be forced to exhaust through valve 28. In order to compensate for such an occurrence, valve 28 must have sufficient capacity to exhaust an amount of air equivalent to that being injected into suit 10 through hose 16, otherwise the suit will balloon or could possibly tear. Solutions to this problem include providing the suit 10 with additional valves 20 so that even if several valves are blocked, a sufficient number of valves is still available for the exhausting air from the suit 10. However, installing valves into the suit is the most labor intensive portion of manufacture and each valve added significantly adds to the cost of production. Therefore, in order to provide adequate exhaust capability it is necessary to use a valve structure and valve placement in combination to achieve suitable exhaust capabilities for respiratory as well as cooling purposes within the suit.

Figure 3:
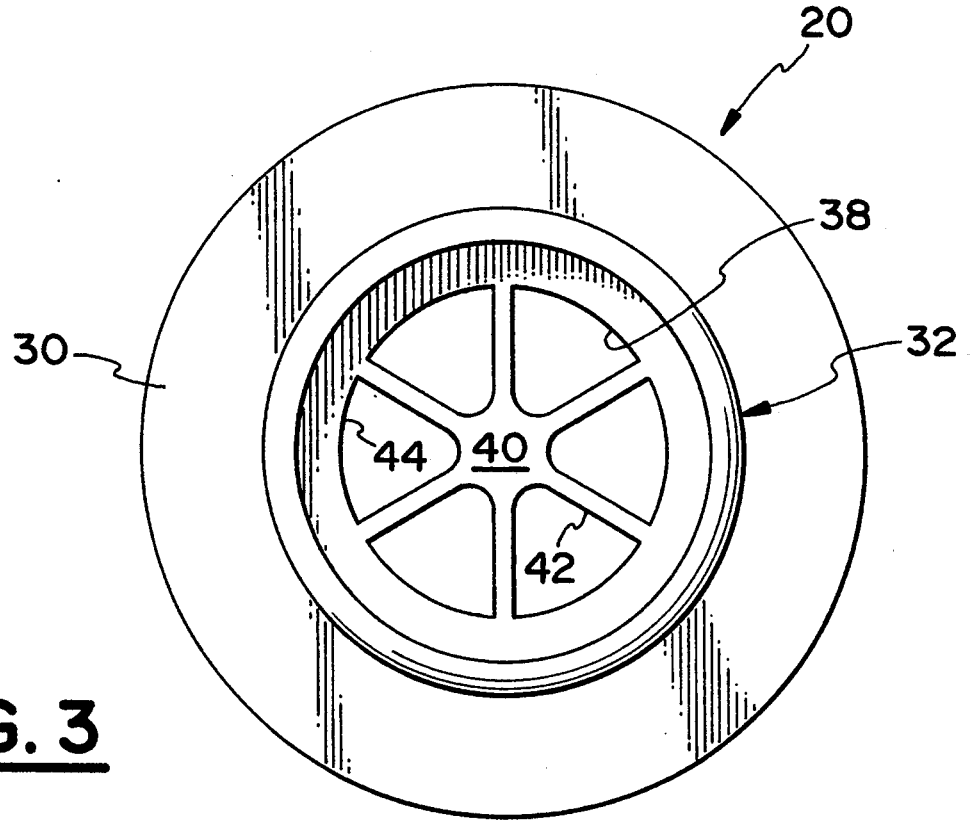
FIG. 3 is a front view of a one-way valve for use with the anti-contamination suit.
Figure 4:
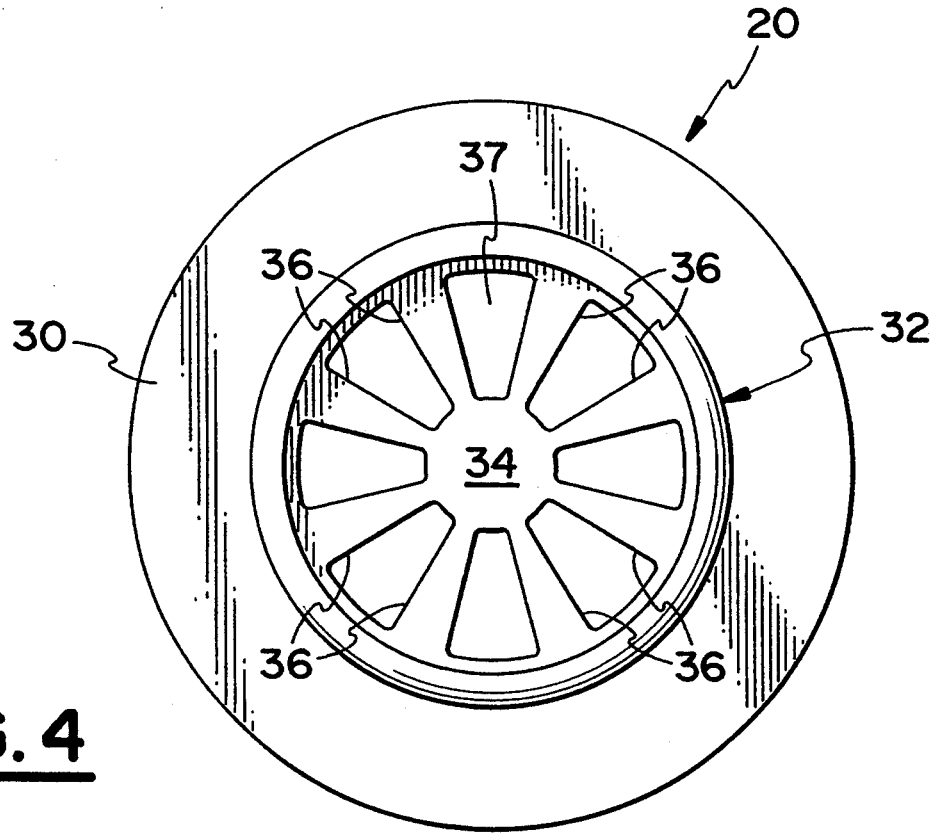
FIG. 4 is a rear view of the one-way valve of FIG. 3.
Figure 5:
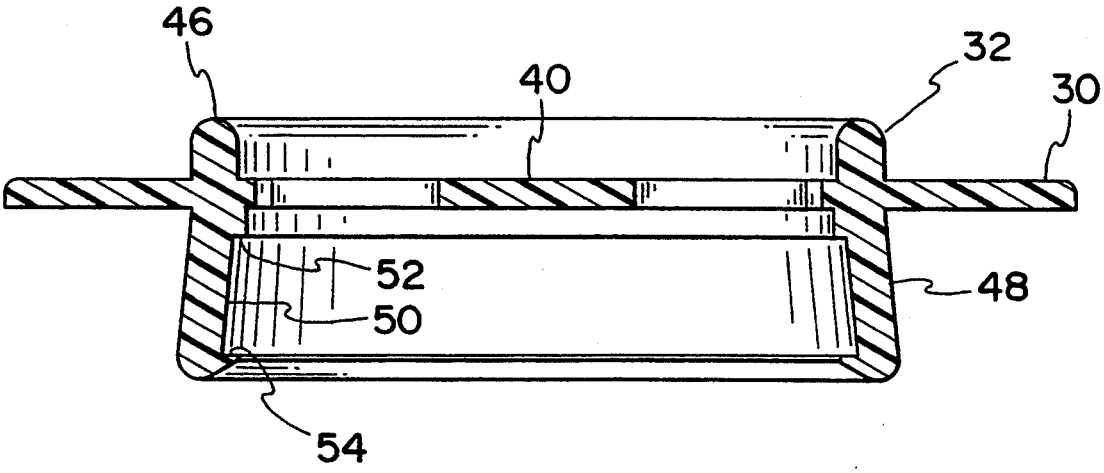
FIGS. 5 and 6 are cross-sectional views of components of the one-way valve of FIGS. 3 and 4.

FIGS. 3–6 show the improved valve design. FIG. 3 is a top view of valve 20 and includes a flange 30 circumscribing the valve housing 32. The valve housing 32 includes a front face 34 formed of a substantially flat portion having a plurality of spaced webs 36 which permit the exhaust of air through the spaces 37 of face 34 of valve 20. In FIG. 4, the flange 30 circumscribing the valve 20 can be see in relation to the valve housing 32. Within the valve housing 32 is a valve membrane support structure 38 formed of substantially rigid plastic material and includes a central disc-shaped portion 40 and a plurality of spider-like legs 42 extending between the outer ring 44 and central disc 40. FIG. 5 shows a cross-sectional view of the valve housing 32 and circumscribing flange 30. As can be seen from FIG. 4, the valve housing 32 includes an upper portion 46 extending above the flange 30 and a lower portion 48 extending below the flange 30. The openings 37 extend through the front face 34 and permit air to pass through face 34 when the valve 20 is in use. Lower portion 48 includes recessed area 50 having an upper lip 52 and a lower lip 54.

Figure 6:
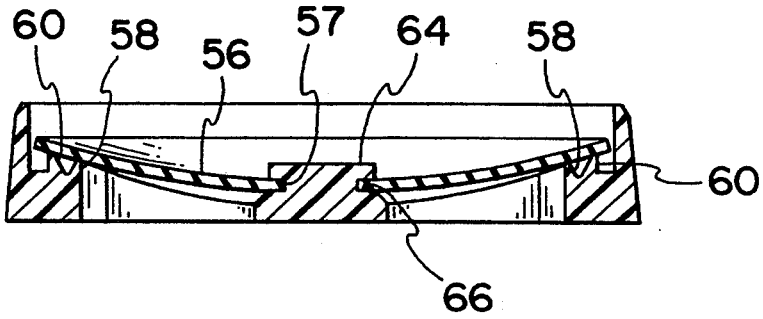
Figure 7:
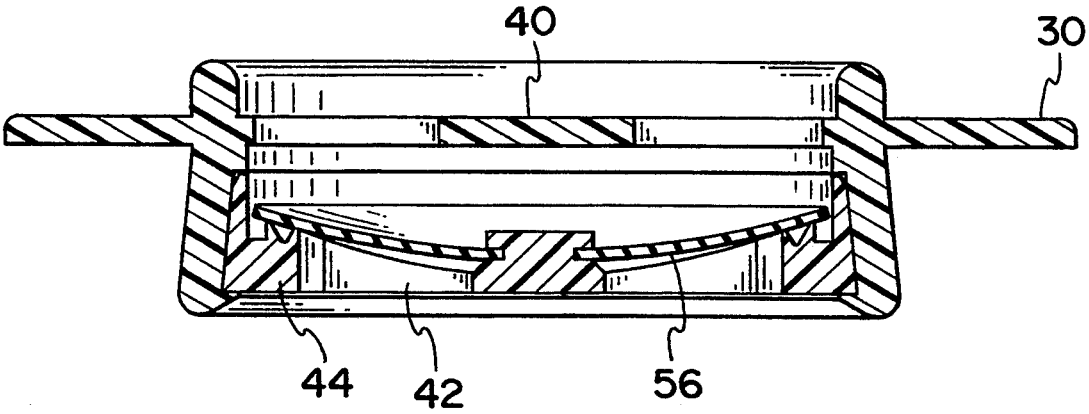

FIG. 6 shows the valve membrane 56 held within the valve membrane support structure 38 which in use is held within recessed area 50 between upper lip 52 and lower lip 54 of the valve housing 32 of FIG. 5. Sealing of the valve membrane 56 is accomplished by seating of the valve membrane 56 against sealing edges 58 and 60. The sealing edges 58 and 60 form substantially an air-tight contact points for the valve membrane 56 to prevent backflow of air into suit 10. The valve membrane 56 includes an opening 5 therein which is best shown in FIGS. 6 and 7 which allows assembly of the valve membrane 56 over the membrane positioning head 64. Head 64 includes a smaller neck 66 so that the elastic membrane opening 62 may be enlarged to fit over head 64 and then retract around neck 66.

FIG. 7 is a cross-sectional view of the assembled valve 20. As shown the central disc 40, legs 42 and outer ring 44 form a flat surface which prevents irritation to the wearer when the suit 10 is worn and the wearer presses against the valve 20 due to kneeling or bracing against a solid object.

Preferably, the acceptable pressures to prevent a ballooning effect of the anti-contamination suit 10 are such that air may flow into the suit and exhaust through the one-way valve without unnecessary expansion or billowing of the suit. An expanded suit can be hazardous to the worker's' safety by obscuring vision and by reducing flexibility. It is important that the suit 10 maintain an unexpanded condition. In order to achieve this object, a flow rate table has been produced and identified below as Table I showing the acceptable back pressure for a given flow rate.

TABLE 1

| Flowrates SCFM | Acceptable Back Pressured (psig) |
|---|---|
| 5 | .015 –.035 |
| 10 | .02–.04 |
| 15 | .03–.05 |
| 20 | .05–.09 |

TABLE 1-continued

| Flowrates SCFM | Acceptable Back Pressured (psig) |
|---|---|
| 25 | .11–.14 |

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. An anti-contamination suit comprising:

a) a body garment for covering substantially all of a human body and a hood connected to said body garment in a substantially air tight manner, and allowing circulation of air from an air inlet throughout said body garment and said hood;

b) said body garment including a plurality of one-way air valves for permitting exhaust of air from the interior of said body garment;

c) each of said one-way air valves being formed of a substantially cylindrically walled base member having an outer end of an inner end and a outer flange member adapted for engaging a clothing surface;

d) said base member including a central perforated wall extending substantially perpendicularly to said cylindrical wall and forming an outer face of the air valve;

e) said inner end of said base member having a lower lip extending perpendicularly from said cylindrical wall toward the center of said base member;

f) a insertable membrane support member for connection to said base member;

g) said support member being sized for engagement with said inner end of said base member between said perforated wall and said lower lip; and h) whereby said membrane is flexible to allow air to exhaust through said perforated wall while preventing air from entering from said perforated wall by seating against said support member.

2. The anti-contamination suit as set forth in claim 1, wherein:

a) said perforated wall forms a web including a central portion and a plurality of spokes extending therefrom.

3. The anti-contamination suit as set forth in claim 1, wherein:

a ) said support member including an outer ring surrounding said membrane supporting web which forms a coplanar rear surface with said web.

4. The anti-contamination suit as set forth in claim 1, wherein:

a) said support member includes a pair of sealing edges circumscribing said web.

5. The anti-contamination suit as set forth in claim 4, wherein:

a) said membrane normally rests against said sealing edges when air is not being exhausted through said perforated wall and prevents engross of air into said suit thereby preventing contamination.

* * * * *